US010290446B2

(12) United States Patent
Oh

(10) Patent No.: US 10,290,446 B2
(45) Date of Patent: May 14, 2019

(54) TRIP DEVICE FOR CIRCUIT BREAKER

(71) Applicant: LSIS CO., LTD., Anyang-si, Gyeonggi-do (KR)

(72) Inventor: Ki Hwan Oh, Cheongju-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 547 days.

(21) Appl. No.: 14/491,567

(22) Filed: Sep. 19, 2014

(65) Prior Publication Data

US 2015/0109091 A1 Apr. 23, 2015

(30) Foreign Application Priority Data

Oct. 17, 2013 (KR) ..... 10-2013-0124178

(51) Int. Cl.

| | |
|---|---|
| ***H01H 37/52*** | (2006.01) |
| ***H01H 71/74*** | (2006.01) |
| *H01H 37/30* | (2006.01) |
| *H01H 37/22* | (2006.01) |

(52) U.S. Cl.

CPC ..... *H01H 37/52* (2013.01); *H01H 71/7409* (2013.01); *H01H 71/7436* (2013.01); *H01H 37/22* (2013.01); *H01H 37/30* (2013.01)

(58) Field of Classification Search

CPC ..... H01H 37/22; H01H 37/24; H01H 37/28; H01H 37/30; H01H 37/52; H01H 71/7409; H01H 71/7436; H01H 2071/7454; H01H 2071/749

USPC ..... 337/351, 360

See application file for complete search history.

(56) References Cited

U.S. PATENT DOCUMENTS

| | | | | |
|---|---|---|---|---|
| 2,755,358 A | | 7/1956 | Dobes et al. | |
| 4,080,582 A | * | 3/1978 | Link | H01H 71/40 335/37 |
| 4,698,606 A | * | 10/1987 | Mrenna | H01H 71/7427 335/45 |
| 4,704,593 A | * | 11/1987 | Leone | H01H 71/7427 335/45 |
| 4,922,220 A | * | 5/1990 | Livesey | H01H 71/74 335/45 |
| 5,266,760 A | | 11/1993 | Link et al. | |

(Continued)

FOREIGN PATENT DOCUMENTS

| | | |
|---|---|---|
| CN | 101488424 | 7/2009 |
| CN | 101770906 | 7/2010 |

(Continued)

OTHER PUBLICATIONS

Hiroyuki, EPO machine translation of JP2001015006.*

(Continued)

*Primary Examiner* — Jacob R Crum

(74) *Attorney, Agent, or Firm* — K&L Gates LLP

(57) ABSTRACT

A trip device for a circuit breaker includes: a crossbar rotatably installed to perform the trigger function; and bimetal that is curved upon the occurrence of an abnormal current and presses and rotates the crossbar by means of a gap adjustment member. The crossbar is movable in the direction of a rotating shaft of the crossbar, and the gap adjustment member is attached to and detached from either the crossbar or the bimetal at varying angles so that a contact surface is parallel or at an angle to the direction of movement of the crossbar.

2 Claims, 23 Drawing Sheets

(56) References Cited

U.S. PATENT DOCUMENTS

| | | | | |
|---|---|---|---|---|
| 5,757,254 | A | 5/1998 | Kurono et al. | |
| 6,255,925 | B1 * | 7/2001 | DiMarco | H01H 71/7463 335/176 |
| 2004/0140881 | A1 * | 7/2004 | Leitl | H01H 71/7436 337/57 |

FOREIGN PATENT DOCUMENTS

| | | | |
|---|---|---|---|
| DE | 9108197 | | 12/1992 |
| EP | 0521390 | A1 | 1/1993 |
| EP | 1482529 | | 12/2004 |
| JP | 2001-15006 | | 1/2001 |
| JP | 2008-270024 | | 11/2008 |
| KR | 10-2002-0018438 | | 3/2002 |
| KR | 101198972 | | 11/2012 |

OTHER PUBLICATIONS

Korean Intellectual Property Office Application Serial No. 10-2013-0124178, Notice of Allowance dated Aug. 26, 2014, 2 pages.
The State Intellectual Property Office of the People's Republic of China Application Serial No. 201410555486.5, Office Action dated Mar. 21, 2016, 5 pages.
European Patent Office Application Serial No. 14186003.1, Search Report dated Apr. 30, 2015, 6 pages.
Japan Patent Office Application Serial No. 2014-211646, Office Action dated May 21, 2015, 2 pages.
Indian Office Action for related Indian Application No. 2739/DEL/2014; action dated Sep. 19, 2018; (6 pages).

* cited by examiner

TRIP DEVICE FOR CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2013-0124178, filed on Oct. 17, 2013, the contents of which are all hereby incorporated by reference herein in its entirety.

BACKGROUND OF THE DISCLOSURE

1. Field of the Disclosure

The present invention relates to a circuit breaker, and more particularly, to a circuit breaker including a lug-type terminal block.

2. Background of the Disclosure

In general, a circuit breaker is an electrical device that manually opens and closes an electrical circuit by a handle, or that protects load devices and circuits by detecting an abnormal current such as a short-circuit current and automatically breaking the circuits.

The circuit breakers include a thermal adjustable type circuit breaker for adjusting the rated current and a thermal fixable type circuit breakers for fixing the rated current at a predetermined value.

Although the thermal fixable type circuit breaker may use different components from those of the thermal adjustable type circuit breaker, it usually uses the same components as the thermal adjustable type circuit breaker for component commonality and only the operating parts are fixed to prevent the user from arbitrarily adjusting the rated current.

Hereinafter, a trip device for a circuit breaker according to the conventional art which implements the thermal adjustable type circuit breaker and the thermal fixable type circuit breaker will be described below with reference to the accompanying FIGS. 1 and 2.

As shown in FIG. 1, a conventional circuit breaker includes a case 10, a fixed contact 20 fixedly mounted in the case 10, a movable contact 30 configured to be brought into contact with and separated from the fixed contact 20, a switching mechanism 40 for opening and closing the movable contact 30, and a trip device OT that detects an abnormal current such as a short-circuit current and automatically triggers the switching mechanism 40 to a trip position.

As shown in FIG. 1, the trip device OT includes a crossbar 70 rotatably installed to perform the trigger function and bimetal 50 that is curved upon the occurrence of an abnormal current and presses and rotates the crossbar 70 by a pressure member 52 formed on one end.

In this case, the crossbar 70 is installed to be movable in the direction of a rotating shaft of the crossbar, as shown in FIG. 2.

A contact surface 52*a* of the pressure member 52 of the bimetal 50 slopes in the direction of movement of the crossbar 70.

This is to adjust the gap between the bimetal 50 and the crossbar 70, more precisely, the gap between the contact surface 52*a* of the pressure member 52 of the bimetal 50 and a contact surface 70*a* of the crossbar 70, by adjusting the position of the crossbar 70 on a rotating shaft, when it is desired to implement the thermal adjustable type circuit breaker.

Hereinafter, the operational effects of the trip device OT for a circuit breaker according to the conventional art will be explained.

That is, when an abnormal current is applied to the conventional circuit breaker, the bimetal 50 bends to the left in FIG. 1 when heated by the applied current, and rotates the crossbar 70 by means the pressure member 52 and unlocks a latch (not shown) of the switching mechanism 40. Once the latch (not shown) is unlocked, the movable contact 30 is quickly separated from the fixed contact 20 by the elastic force of a trip spring (not shown) of the switching mechanism 40.

For this procedure, the trip device OT for the conventional circuit breaker is equipped with the crossbar 70 which is movable in the direction of the rotating shaft and the contact surface 52*a* of the pressure member 52 of the bimetal 50 which slopes in the direction of movement of the crossbar 70.

As such, the trip device OT for the conventional circuit breaker is able to adjust the gap between the bimetal 50 and the crossbar 70 by adjusting the position of the crossbar 70 on the rotating shaft, thereby implementing the thermal adjustable type circuit breaker for rated current adjustment.

Meanwhile, when implementing the thermal fixable type circuit breaker for fixing the rated current, the trip device OT for the conventional circuit breaker uses the same types of crossbar 70 and bimetal 50 to achieve component commonality, and fixes the crossbar 70 at a predetermined position on the rotating shaft so that the gap between the bimetal 50 and the crossbar 70 is fixed at a predetermined value.

In the trip device OT for the conventional circuit breaker, however, the crossbar 70 is placed into an unintended position due to any distribution or assembly error in the components. This changes the gap between the bimetal 50 and the crossbar 70. As a result, a scatter diagram of overcurrent time is large, and the reliability of a trip operation is deteriorated.

SUMMARY OF THE DISCLOSURE

Therefore, an aspect of the present invention is to provide a trip device for a circuit breaker which implements both a thermal adjustable type circuit breaker for adjusting the rated current and a thermal fixable type circuit breaker for fixing the rated current at a predetermined value, and solves the problem of deterioration in the reliability of a trip operation by minimizing a scatter diagram of overcurrent caused by a distribution or assembly error in the components when implementing the thermal adjustable type circuit breaker.

To achieve these and other advantages and in accordance with the purpose of this specification, as embodied and broadly described herein, there is provided a trip device for a circuit breaker, including: a crossbar rotatably installed to perform the trigger function; and a bimetal that is curved upon the occurrence of an abnormal current and presses and rotates the crossbar by means of a gap adjustment member.

The crossbar may be movable in the direction of a rotating shaft of the crossbar.

The gap adjustment member may be attached to and detached from either the crossbar or the bimetal at varying angles so that a contact surface of the gap adjustment member is parallel or at an angle to the direction of movement of the crossbar.

If the contact surface of the gap adjustment member is at an angle to the direction of movement of the crossbar, the gap between the contact surfaces may be adjusted depending on the position of the crossbar on the rotating shaft.

If the contact surface of the gap adjustment member is parallel to the direction of movement of the crossbar, the gap between the contact surfaces may be kept constant regardless of the position of the crossbar on the rotating shaft.

The gap adjustment member may include: a side which is flat; and a rear side which is at an angle to the side face.

The gap adjustment member may be reversibly attached and detached so that the side face becomes a contact surface which is parallel to the direction of movement of the crossbar or the rear side becomes a contact surface which is at an angle to the direction of movement of the crossbar.

The bimetal may be in the shape of a plate whose one end is fixed and whose the other end is curvable, and the gap adjustment member may be attached and detached to and from the other end of the bimetal.

The gap adjustment member may further include a bottom side which is perpendicular to the side face and the rear side.

A rectangular shaped insertion slot may be formed on the bottom side to receive the other end of the bimetal.

The length and depth directions of the insertion slot may be parallel to the side face.

The length and depth directions of the insertion slot may be parallel to the rear side.

The length direction of the insertion slot refers to the direction along which the long side of a rectangular opening of the insertion slot runs, and the depth direction of the insertion slot refers to the direction of insertion of the other end of the bimetal.

The bimetal may include an insertion protrusion protruding in the direction of curvature from the other end.

The gap adjustment member may include an insertion slot penetrating the gap adjustment member at right angles from the side face.

The insertion protrusion may be inserted into the insertion slot.

The gap adjustment member may include a side face which is flat.

The gap adjustment member may be rotatably attached and detached so that the side face becomes a contact surface which is parallel or at an angle to the direction of movement of the crossbar.

A cylindrical insertion slot and a cylindrical insertion protrusion may be formed as the insertion parts of the gap adjustment member and bimetal so that the gap adjustment member rotates at a desired angle.

A plurality of slip-resistant grooves may be formed on the inner peripheral surface of the cylindrical insertion slot in the depth direction of the cylindrical insertion slot.

At least one slip-resistant protrusions may be formed on the outer peripheral surface of the cylindrical insertion protrusion to get caught in the slip-resistant grooves.

The bimetal may be in the shape of a plate whose one end is fixed and whose the other end is curvable, and the gap adjustment member may be attached and detached to and from the other end of the bimetal.

The gap adjustment member may further include a bottom side which is perpendicular to the side face.

First and second insertion slots having a rectangular shape may be formed on the bottom side, the length and depth directions of the first insertion slot being parallel to the side face, and the depth direction of the second insertion slot being parallel to the depth direction of the first insertion slot, and the length direction of the second insertion slot being at an angle to the length direction of the first insertion slot.

The other end of the bimetal may be inserted into the first insertion slot or the second insertion slot.

The length direction of the insertion slot refers to the direction along which the long side of a rectangular opening of the insertion slot runs, and the depth direction of the insertion slot refers to the direction of insertion of the other end of the bimetal.

The gap adjustment member may further include a lateral side which is perpendicular to the side face.

First and second insertion slots may be formed on the lateral side, the depth direction of the first insertion slot being parallel to the side face, and the depth direction of the second insertion slot being at an angle to the side face.

The bimetal may further include an insertion protrusion that protrudes from the other end and inserted into the first insertion slot or the second insertion slot.

The depth direction of the insertion slots refers to the direction of insertion of the insertion protrusion.

The bimetal may include an insertion protrusion protruding in the direction of curvature from the other end.

The gap adjustment member may include: a first insertion slot which is perpendicular to the side face from the rear side facing the side face; and a second insertion slot which is at an angle to the side face.

The insertion protrusion may be inserted into the first insertion slot or the second insertion slot.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE DISCLOSURE

Hereinafter, a trip device for a circuit breaker according to an exemplary embodiment of the present invention will be described with reference to the accompanying drawings.

Figure 1:
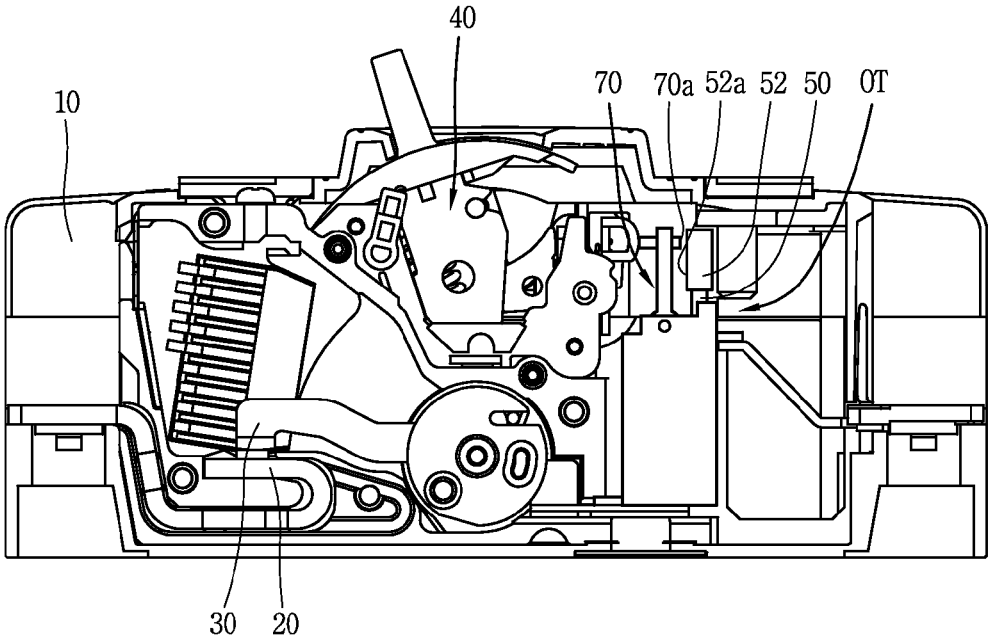
FIG. 1 CONVENTIONAL ART
FIG. 1 is a cross-sectional view showing a conventional circuit breaker.
Figure 2:
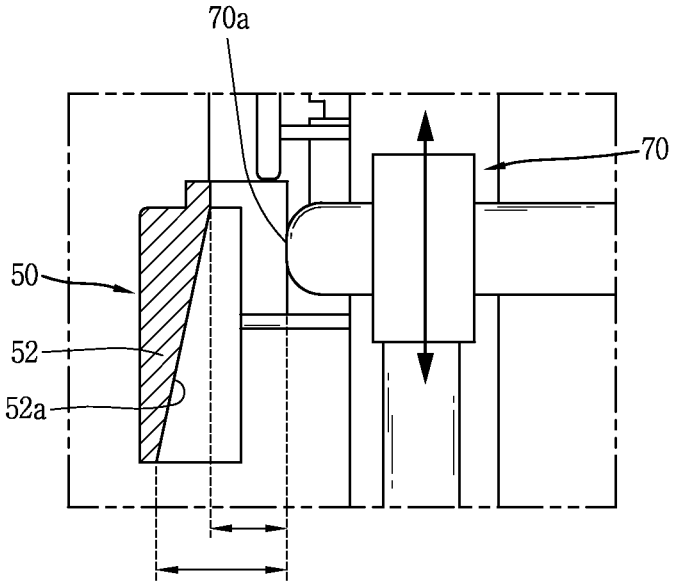
FIG. 2 CONVENTIONAL ART
FIG. 2 is a plan view showing the trip device of FIG. 1.
Figure 3:
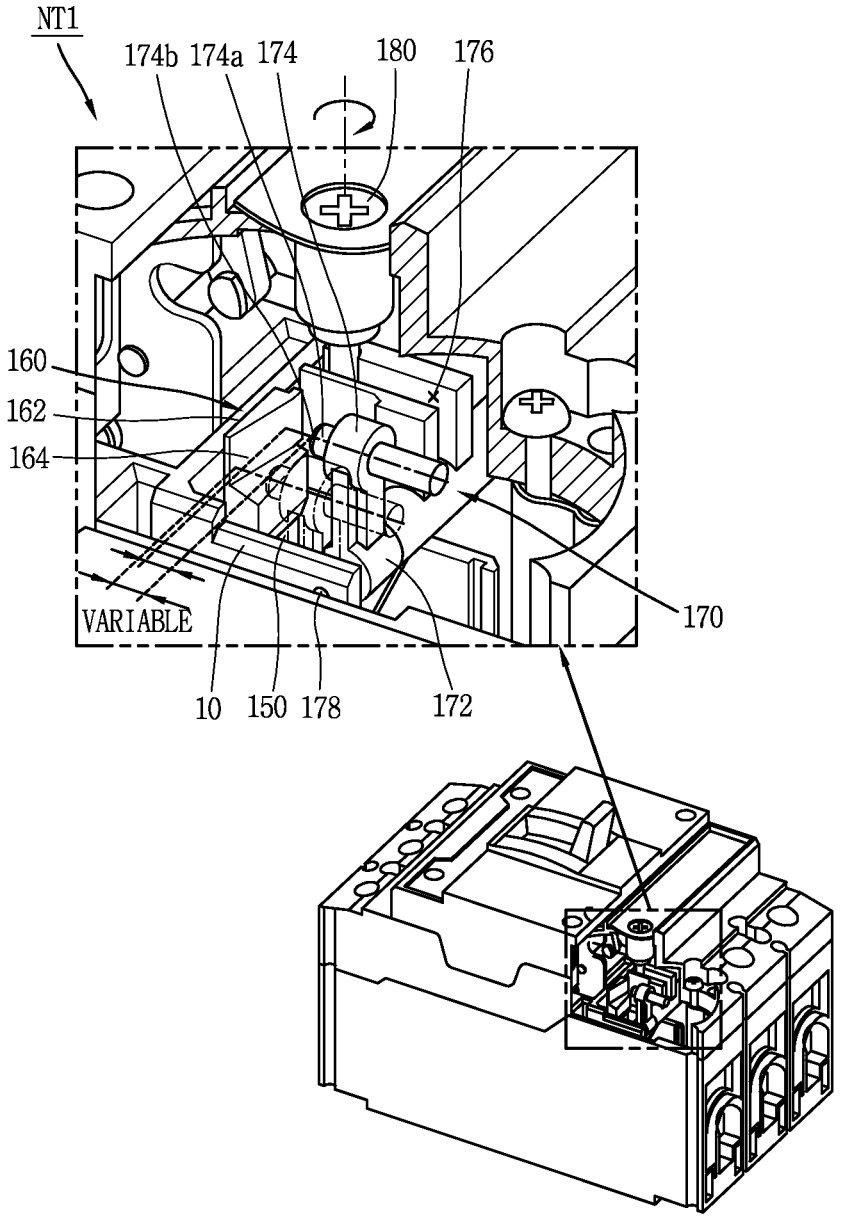
FIG. 3 is a perspective view showing a trip device according to a first exemplary embodiment of the present invention.
Figure 4:
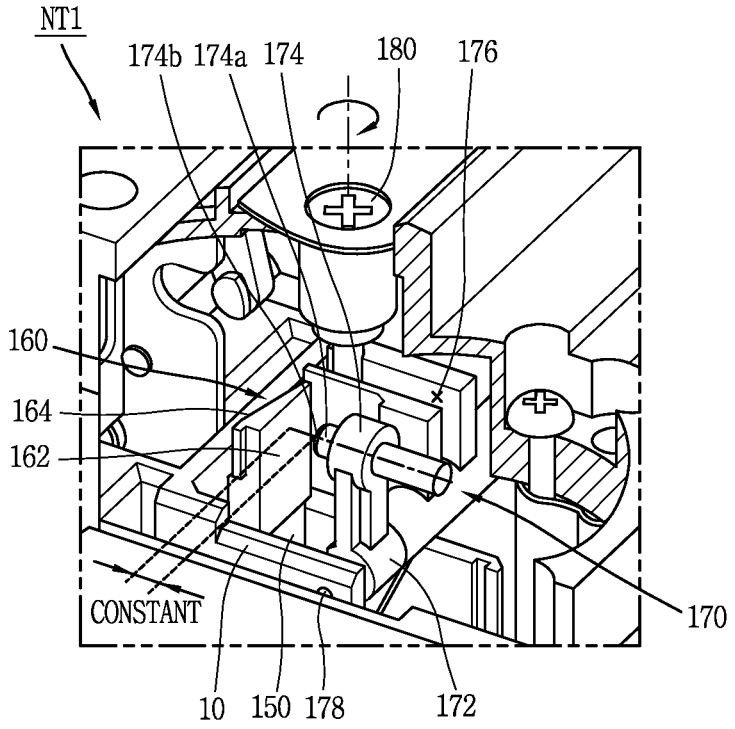
FIG. 4 is a perspective view showing the gap adjustment member of FIG. 3 mounted turned back to front.
Figure 5:
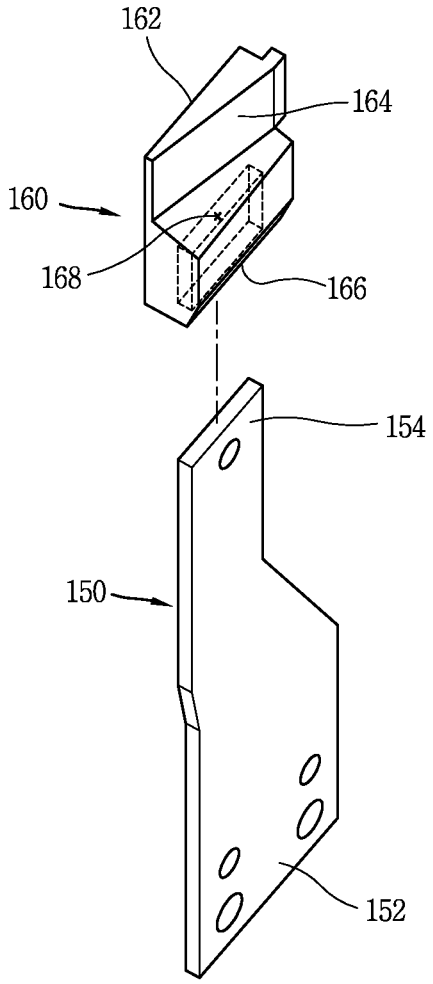
FIG. 5 is an assembly diagram showing the gap adjustment member of FIG. 3 being mounted on bimetal.
Figure 6:
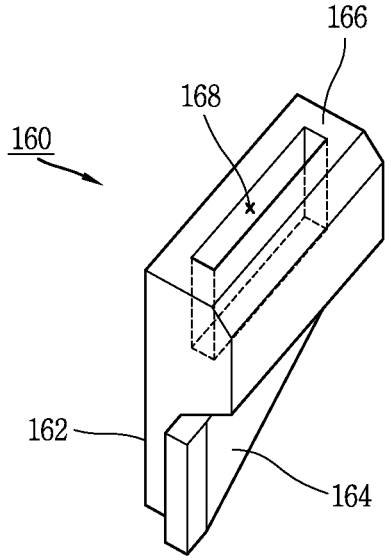
FIG. 6 is a perspective view of the gap adjustment member of FIG. 5 as viewed from the bottom.
Figure 7:
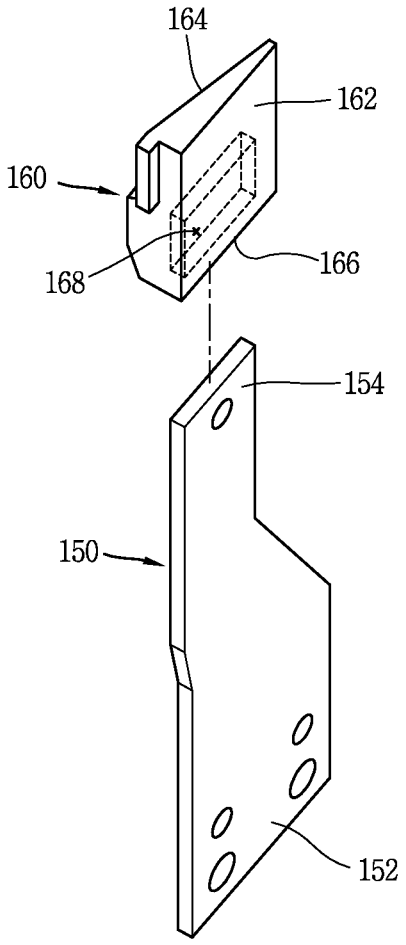
FIG. 7 is an assembly diagram showing the gap adjustment member of FIG. 5 being mounted turned back to front.

FIG. 3 is a perspective view showing a trip device according to a first exemplary embodiment of the present invention. FIG. 4 is a perspective view showing the gap adjustment member of FIG. 3 mounted turned back to front. FIG. 5 is an assembly diagram showing the gap adjustment member of FIG. 3 being mounted on bimetal. FIG. 6 is a perspective view of the gap adjustment member of FIG. 5 as viewed from the bottom. FIG. 7 is an assembly diagram showing the gap adjustment member of FIG. 5 being mounted turned back to front.

As shown in FIGS. 3 to 7, a trip device NT1 for a circuit breaker according to a first exemplary embodiment of the present invention includes: a crossbar 170 that is rotatably installed to perform the trigger function and movable in the direction of a rotating 178 shaft of the crossbar; bimetal 150 that is curved upon the occurrence of an abnormal current and presses and rotates the crossbar 170 by means of an reversible gap adjustment member 160 to be described later; and the reversible gap adjustment member 160 that is attached to and detached from the bimetal 150 at varying angles so that a contact surface is parallel or at an angle to the direction of movement of the crossbar 170.

The crossbar 170 includes a pipe-like body portion 172, a contact portion 174 extending from the body portion 172, and a slot portion 176 for moving the crossbar 170 provided on one side of the body portion 172. The crossbar 170 is installed in a case 10 of the circuit breaker to be rotatable by the rotating shaft 178 penetrating the body portion 172 and movable in the direction of the rotating shaft.

The contact portion 174 includes a cylindrical contact protrusion 174*a* protruding in the direction of the tangent to a circular trajectory around the rotating shaft 178.

The end of the contact portion 174 includes a crossbar contact surface 174*b* that is at right angles to the length of the contact protrusion 174*a*, with a rounded edge on one side of the contact protrusion 174.

The bimetal 150 is an object that composed of two different sides made of different materials joined together.

The bimetal 150 has a plate shape, and includes one end 152 supported on a bracket (not shown) and the other end 154 that is curved when heated.

The reversible gap adjustment member 160 includes a side face 162 which is flat, a rear side 164 which is at an angle to the side face 162, and a bottom side 166 which is perpendicular to the side face 162 and the rear side 164.

An insertion slot 168 is formed on the bottom side 166 of the reversible gap adjustment member 160 to attach and detach the reversible gap adjustment member 160 to and from the other end 154 of the bimetal 150.

In this case, the insertion slot 168 is formed in the shape of a long hole to receive the other end 154 of the plate-shaped bimetal 150.

The length and depth directions of the insertion slot 168 are parallel to the side face 162 of the reversible gap adjustment member 160. As used herein, the length direction of the insertion slot 168 refers to the direction along which the long side of a rectangular opening of the insertion slot 168 runs, and the depth direction of the insertion slot 168 refers to the direction of insertion of the other end 154 of the bimetal 150.

As such, the reversible gap adjustment member 160 is reversibly attached to and detached from the other end 154 of the bimetal 150 so that the side face 162 becomes a contact surface which is parallel to the direction of movement of the crossbar 170 or the rear side 164 becomes a contact surface which is at an angle to the direction of movement of the crossbar 170.

By the way, the other end 154 of the bimetal 150 and the insertion slot 168 of the reversible gap adjustment member 160 can come in various shapes, so long as the reversible gap adjustment member 160 can be reversibly attached to and detached from the other end 154 of the bimetal 150 so that the side face 162 becomes a contact surface which is parallel to the direction of movement of the crossbar 170 or the rear side 164 becomes a contact surface which is at an angle to the direction of movement of the crossbar 170. In other words, as long as the side face 162 of the reversible gap adjustment member 160 faces the crossbar contact surface 174*b* parallel or the rear side 164 of the reversible gap adjustment member 160 faces the crossbar contact surface 174*b* at an angle, the insertion parts of the bimetal 150 and reversible gap adjustment member 160 can come in various shapes.

Figure 8:
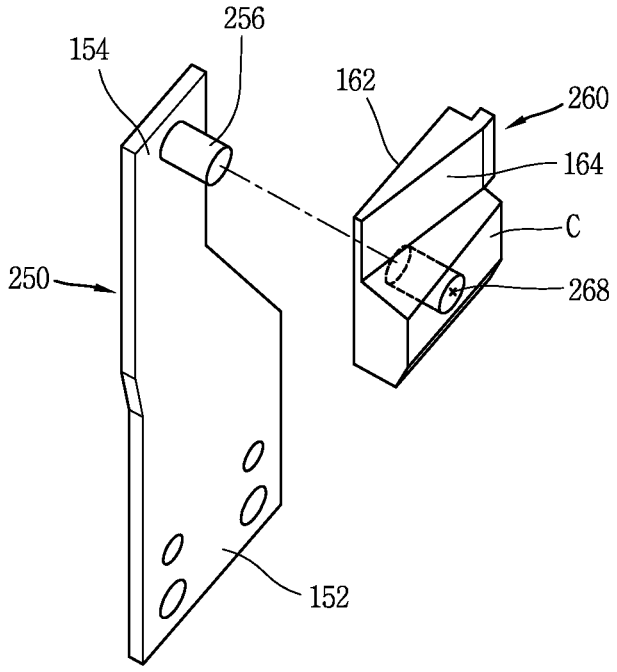
FIG. 8 is an assembly diagram showing an example of a variation of the insertion parts of the gap adjustment member and bimetal of FIG. 3.
Figure 9:
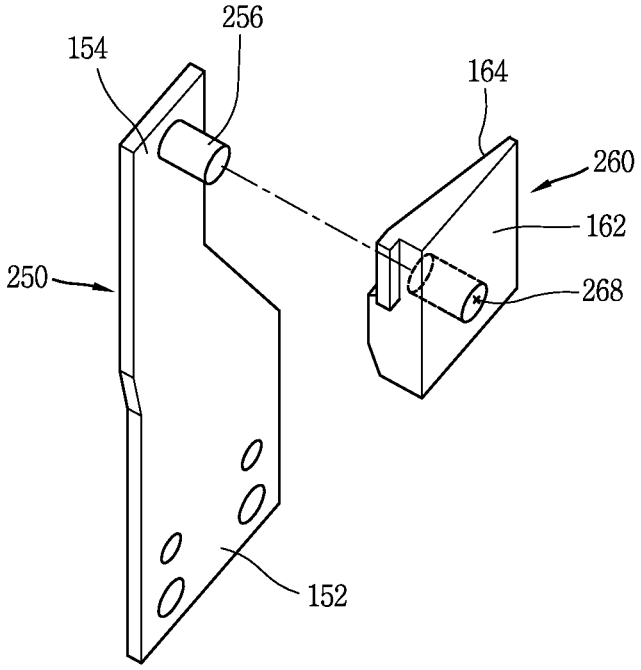
FIG. 9 is an assembly diagram showing the gap adjustment member of FIG. 8 being mounted turned back to front.

FIG. 8 is an assembly diagram showing an example of a variation of the insertion parts of the gap adjustment member and bimetal of FIG. 3. FIG. 9 is an assembly diagram showing the gap adjustment member of FIG. 8 being mounted turned back to front.

In an example, as shown in FIGS. 8 and 9, an insertion protrusion 256 protruding in the direction of curvature may be formed on the other end 154 of the bimetal 150. In this case, an insertion slot 268 may be formed in the reversible gap adjustment member 260 to penetrate a rectangular part C, one side of which being the side face 162 of the reversible gap adjustment member 160, at right angles from the side face 162.

In another example, although not shown, the length and depth directions of the long hole-shaped insertion slot 168 may be parallel to the reversible gap adjustment member 160.

Moreover, in the trip device NT1 for a circuit breaker according to the first exemplary embodiment of the present invention and a modification of the trip device NT1, the reversible gap adjustment member 160 and 260 may be attached to and detached from the other end 154 of the bimetal 150. Alternatively, the reversible gap adjustment member 160 and 260 may be attached to and detached from the contact portion 174 of the crossbar 170, and the illustration and detailed description thereof will be omitted because the same technical concept applies except the gap adjustment member 160 and 260 is attached to and detached from the crossbar 170, instead of the bimetal 150 and 250.

In the drawings, the same reference numerals will be given to the same parts as the conventional art.

Hereinafter, the operational effects of the trip device NT1 for a circuit breaker according to the first exemplary embodiment of the present invention will be described.

As shown in FIG. 3, in the trip device NT1 for a circuit breaker according to the first exemplary embodiment of the present invention, the reversible gap adjustment member 160 may be mounted on the bimetal 150 so that the rear side 164 becomes a contact surface which is at an angle to the direction of movement of the crossbar 170. In other words, the reversible gap adjustment member 160 may be mounted on the bimetal 150 to make the rear side 164 face the crossbar contact surface 174*b* at an angle.

Alternatively, as shown in FIG. 4, the reversible gap adjustment member 160 may be mounted on the bimetal 150 so that the side face 162 becomes a contact surface parallel to the direction of movement of the crossbar 170. In other words, the reversible gap adjustment member 160 may be mounted on the bimetal 150 to make the side face 162 face the crossbar contact surface 174*b* parallel.

When the reversible gap adjustment member 160 is mounted on the bimetal 150 so that the rear side 164 faces the crossbar contact surface 174*b* at an angle, the reversible gap adjustment member 160 functions to adjust the rated current of the circuit breaker depending on the position of the crossbar 170 on the rotating shaft. In other words, the reversible gap adjustment member 160 functions to implement the circuit breaker as the thermal adjustable type circuit breaker.

More specifically, the crossbar 170 may be moved in the direction of the rotating shaft by turning a knob 180, with one end brought into contact with the slot portion 176 and the other end exposed to the surface of the case 10 of the circuit breaker.

As such, the crossbar contact surface 174*b* may be shifted in position.

As a result, the gap between the contact surfaces 174*b* and 164 may be adjusted depending on which part of the rear side 164 of the reversible gap adjustment member 160, which is a contact surface of the reversible gap adjustment member 160, the crossbar contact surface 174*b* is brought into contact with.

As the gap is adjusted, the rated current of the circuit breaker can be adjusted.

For example, if the gap is small, even a slight curvature of the bimetal 150 can bring the rear side 164 of the reversible gap adjustment member 160 into contact with the crossbar contact surface 174*b* to trigger a trip operation. That is, a circuit breaker with a low current rating is achieved.

On the other hand, if the gap is large, the bimetal 150 must be curved sharply to bring the rear side 164 of the reversible gap adjustment member 160 into contact with the crossbar contact surface 174*b* to trigger a trip operation. That is, a circuit breaker with a high current rating is achieved.

Meanwhile, once the reversible gap adjustment member 160 is mounted on the bimetal 150 so that the side face 162 faces the crossbar contact surface 174*b* parallel, the reversible gap adjustment member 160 functions to fix the rated current of the circuit breaker at a predetermined value regardless of the movement of the crossbar 170 in the direction of the rotating shaft or the occurrence of any scatter diagram of the position of the crossbar 170 on the rotating shaft caused by a distribution or assembly error in the components. In other words, the reversible gap adjustment member 160 functions to implement the thermal adjustable type circuit breaker using the thermal fixable type circuit breaker.

More specifically, the crossbar 170 may be likewise moved in the direction of the rotating shaft by turning the knob 180.

As such, the crossbar contact surface 174*b* may be shifted in position.

Even with this positional shift, the gap between the contact surfaces 174*b* and 162 may be kept constant even if the crossbar contact surface 174*b* is brought into contact with any part of the side face 162, which is a contact surface of the reversible gap adjustment member 160.

Moreover, distribution assembly errors may occur in the components of the trip device during manufacture.

This may cause a deviation in the position of the crossbar 170, i.e., the crossbar contact surface 174*b*, on the rotating shaft.

Even with this deviation, as described above, the gap between the contact surfaces 174*b* and 162 is kept constant even if the crossbar contact surface 174*b* is brought into contact with any part of the side face 162 of the reversible gap adjustment member 160.

Accordingly, the bimetal 150 must be curved sharply to bring the rear side 164 of the reversible gap adjustment member 160 into contact with the crossbar contact surface 174*b* to trigger a trip operation. That is, a circuit breaker with a rate current fixed at a predetermined value is achieved.

The trip device NT1 for a circuit breaker according to the first exemplary embodiment of the present invention may include the crossbar 170 rotatably installed to perform the trigger function, and the bimetal 150 that is curved upon the occurrence of an abnormal current and presses and rotates the crossbar 170 by means of the gap adjustment member 160.

The crossbar 170 may be movable in the direction of the rotating shaft.

The reversible gap adjustment member 160 may include a side face 162 which is flat and a rear side 164 which is at an angle to the side face 162.

The reversible gap adjustment member 160 may be reversibly attached to and detached from either the crossbar 170 or the bimetal 150 so that the side face 162 becomes a contact surface which is parallel to the direction of movement of the crossbar 170 or the rear side 164 becomes a contact surface which is at an angle to the direction of movement of the crossbar 170.

As such, when the rear side 164 becomes the contact surface, the trip device NT1 for a circuit breaker according to the first exemplary embodiment of the present invention can adjust the gap between the contact surfaces 174*b* and 164 depending on the position of the crossbar 170 on the rotating shaft. In other words, the thermal adjustable type circuit breaker for adjusting the rated current can be implemented.

When the side face 162 becomes the contact surface, the trip device NT1 for a circuit breaker according to the first exemplary embodiment of the present invention can keep the gap between the contact surfaces 174*b* and 164 constant regardless of the position of the crossbar 170 on the rotating shaft. In other words, the thermal adjustable type circuit breaker for fixing the rated current at a predetermined value can be implemented.

Accordingly, the trip device NT1 for a circuit breaker according to the first exemplary embodiment of the present invention contributes to reducing manufacturing costs by using the same components for the two different types of circuit breakers.

Besides, the trip device NT1 for a circuit breaker according to the first exemplary embodiment of the present invention can solve the problem of deterioration in the reliability of a trip operation by minimizing a scatter diagram of overcurrent caused by a distribution or assembly error in the components when implementing the thermal adjustable type circuit breaker.

The operational effects of the modification of the above-described trip device NT1 for a circuit breaker according to the first exemplary embodiment of the present invention are identical or substantially identical to those of the first exemplary embodiment, so a description thereof will be omitted.

Figure 10:
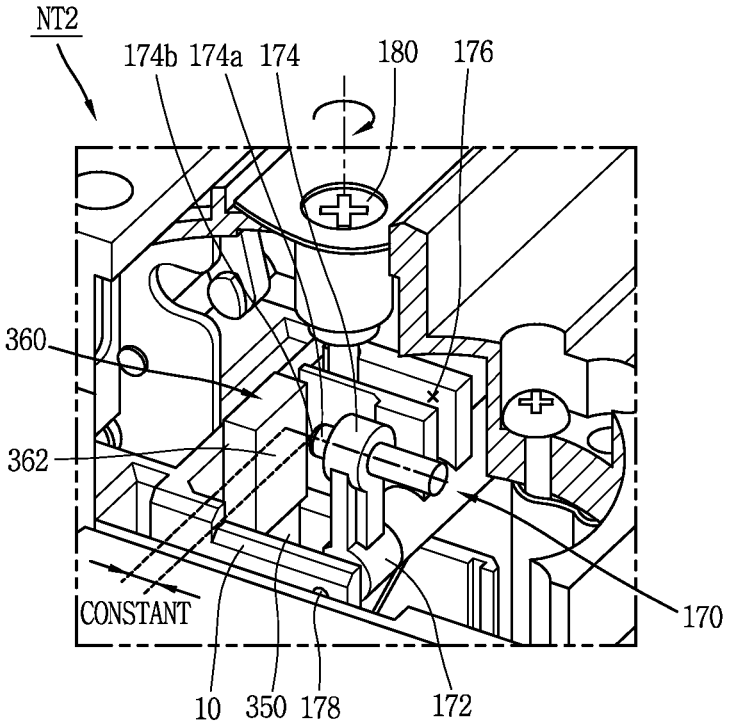
FIG. 10 is a perspective view showing a trip device according to a second exemplary embodiment of the present invention.
Figure 11:
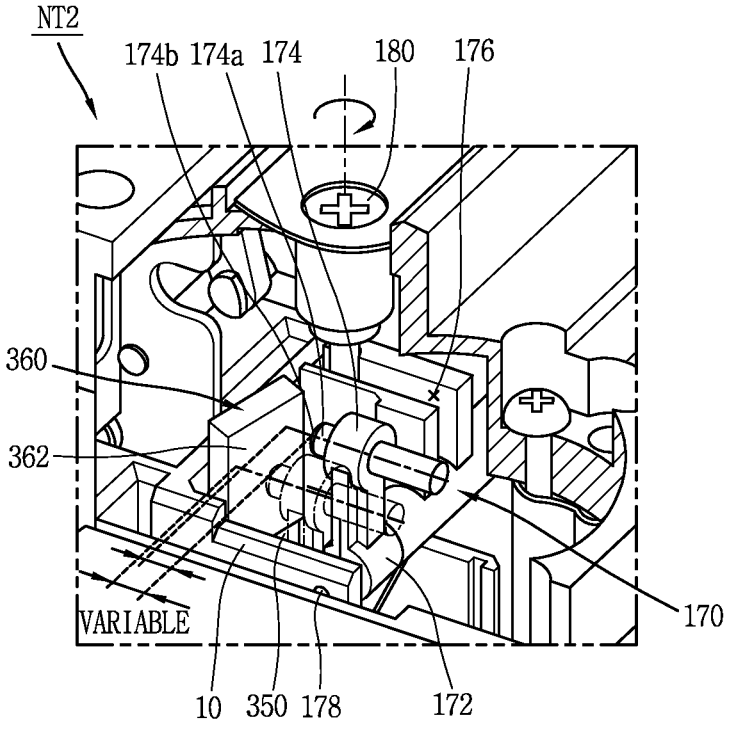
FIG. 11 is a perspective view showing the gap adjustment member of FIG. 10 being mounted at a tilt.

FIG. 10 is a perspective view showing a trip device according to a second exemplary embodiment of the present invention. FIG. 11 is a perspective view showing the gap adjustment member of FIG. 10 being mounted at a tilt.

Figure 12:
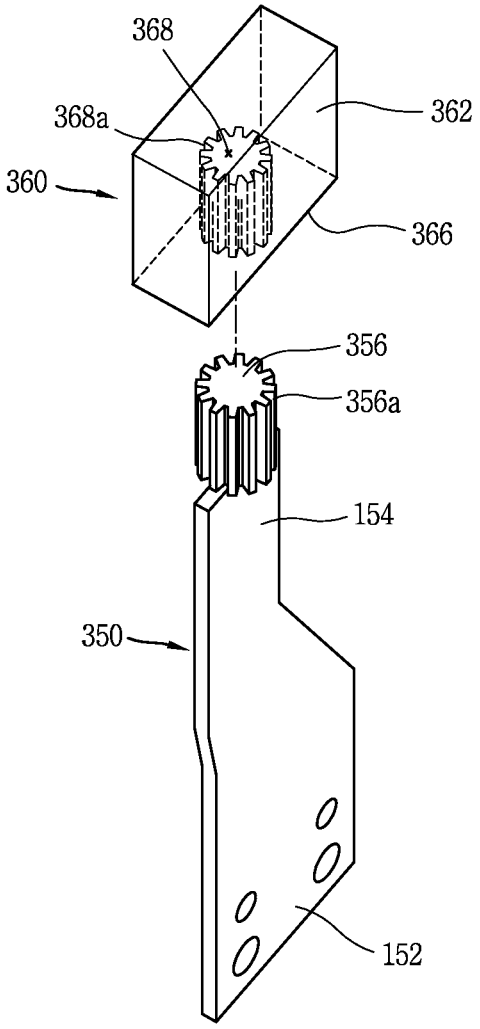
FIG. 12 is an assembly diagram showing the gap adjustment member of FIG. 10 being mounted on the bimetal.
Figure 13:
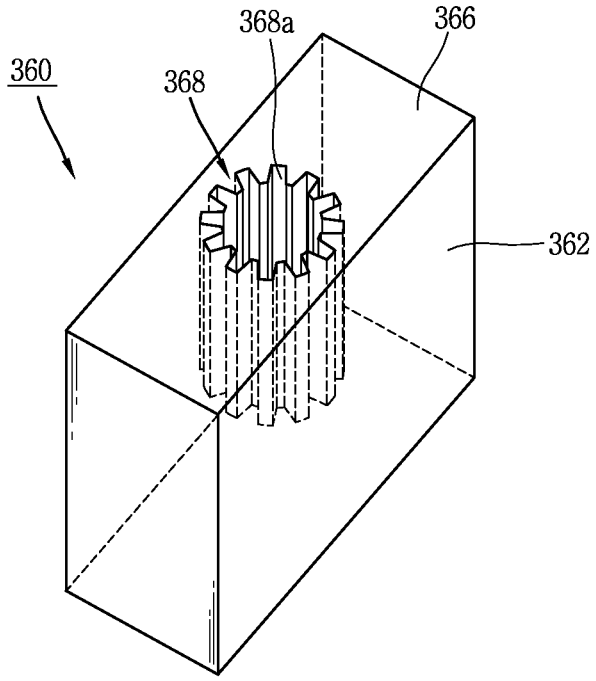
FIG. 13 is a perspective view of the gap adjustment member of FIG. 12 as viewed from the bottom.
Figure 14:
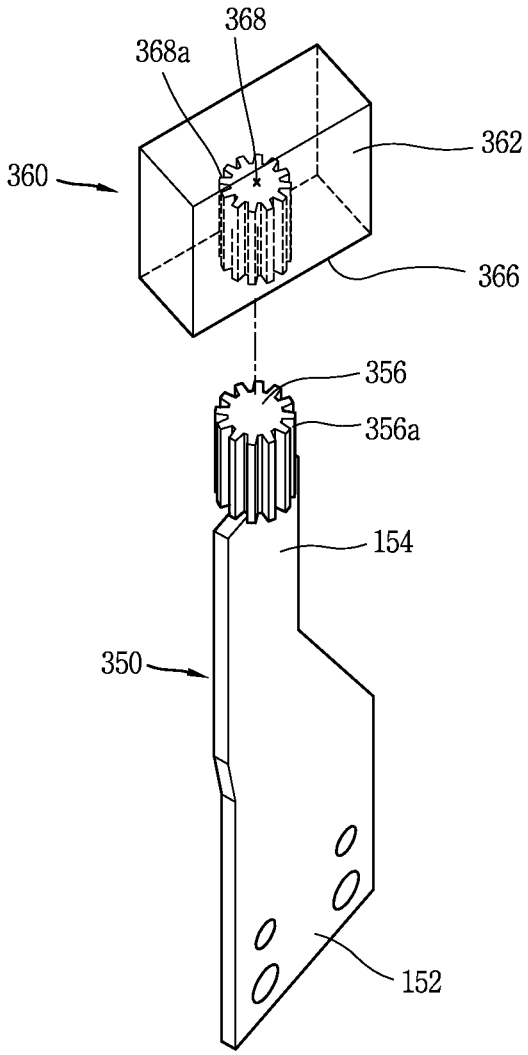
FIG. 14 is an assembly diagram showing the gap adjustment member of FIG. 12 being mounted at a tilt.
Figure 15A:
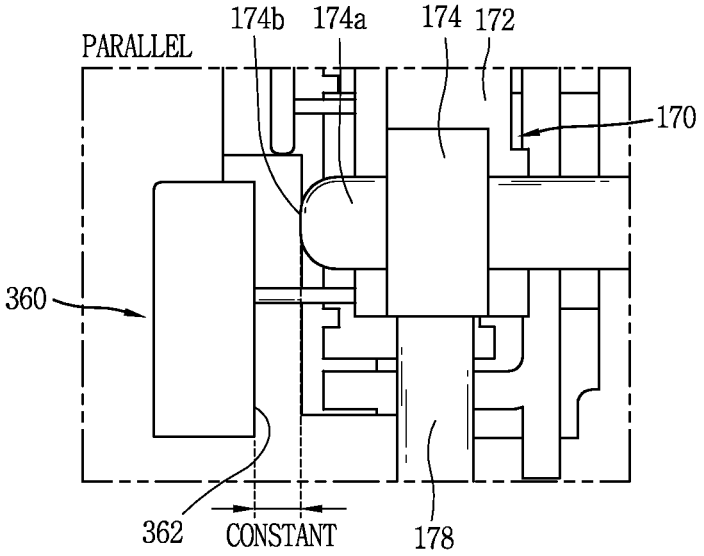
FIG. 15A, FIG. 15B and FIG. 15C are plan views showing the gap adjustment range varying with the angle of rotation of the gap adjustment member of FIG. 12.
Figure 15B:
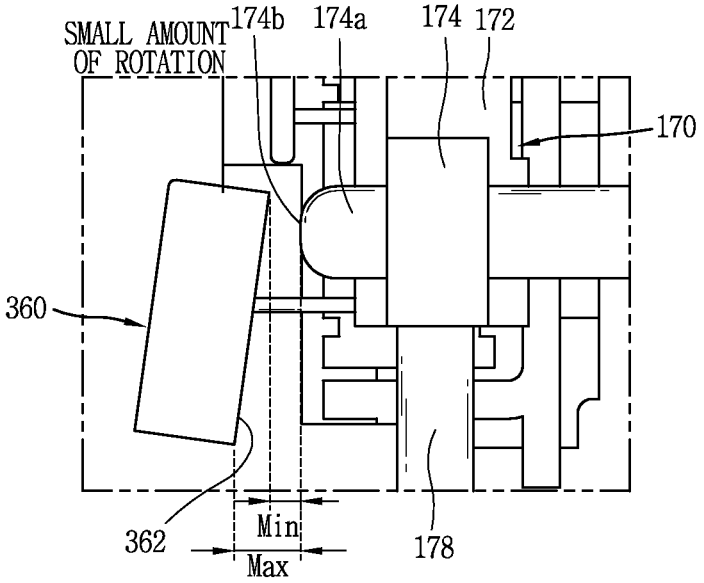
Figure 15C:
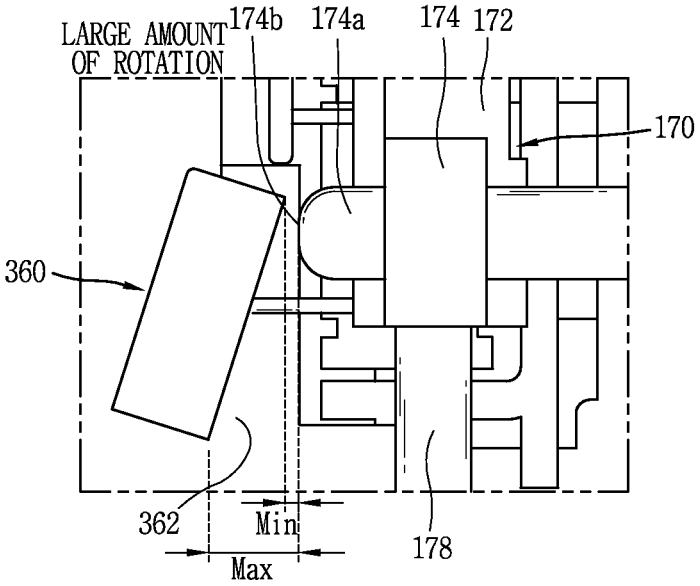

FIG. 12 is an assembly diagram showing the gap adjustment member of FIG. 10 being mounted on the bimetal. FIG. 13 is a perspective view of the gap adjustment member of FIG. 12 as viewed from the bottom. FIG. 14 is an assembly diagram showing the gap adjustment member of FIG. 12 being mounted at a tilt. FIG. 15A, FIG. 15B and FIG. 15C are plan views showing the gap adjustment range varying with the angle of rotation of the gap adjustment member of FIG. 12.

As shown in FIGS. 10 to 15C, the only difference in configuration between a trip device NT2 for a circuit breaker according to the second exemplary embodiment of the present invention and that of the first exemplary embodiment is that a rotatable gap adjustment member 360 replaces the reversible gap adjustment member 160.

That is, the trip device NT2 for a circuit breaker according to the second exemplary embodiment of the present invention includes: a crossbar 170 that is rotatably installed to perform the trigger function and movable in the direction of a rotating shaft of the crossbar; bimetal 350 that is curved upon the occurrence of an abnormal current and presses and rotates the crossbar 370 by means of a rotatable gap adjustment member 360 to be described later; and the rotatable gap adjustment member 360 that is attached to and detached from the bimetal 350 at varying angles so that a contact surface is parallel or at an angle to the direction of movement of the crossbar 370.

The crossbar 370 is identical to that of the first exemplary embodiment, so a description thereof will be omitted to avoid redundancy.

The bimetal 350 is an object that composed of two different sides made of different materials joined together.

The bimetal 350 has a plate shape, and includes one end 152 supported on a bracket (not shown) and the other end 154 that is curved when heated.

The rotatable gap adjustment member 360 includes a side face 362 which is flat and a bottom side 366 which is perpendicular to the side face 362.

In this case, an insertion slot 368 is formed in the shape of an indented cylinder on the bottom side 366 of the rotatable gap adjustment member 360 so that the rotatable gap adjustment member 360 rotates at a desired angle, and a cylindrical insertion protrusion 356 protruding in the direction of the bimetal 350 is formed on the other end 154 of the bimetal 150. A plurality of slip-resistant grooves 368*a* are formed on the inner peripheral surface of the cylindrical insertion slot 368 in the depth direction of the cylindrical insertion slot 368.

A plurality of slip-resistant protrusions 356*a* are formed on the outer peripheral surface of the cylindrical insertion protrusion 356 to get caught in the slip-resistant grooves 368*a*.

Only one or no slip-resistant protrusions 356 may be formed so long as undesired rotation of the rotatable gap adjustment member 360 can be suppressed. Optionally, the slip-resistant protrusions 356 and the slip-resistant grooves 368*a* may be omitted.

Moreover, the cylindrical insertion slot 368 and the insertion protrusion 356 may be the other way around. In other words, the cylindrical insertion protrusion 356 may be formed on the bottom side 366 of the gap adjustment member 360, and the cylindrical insertion slot 368 may be formed on the other end 254 of the bimetal 350.

The cylindrical insertion slot 368 and the insertion protrusion 356 are used as the insertion parts of the rotatable gap adjustment member 360 and bimetal 350 so that the rotatable gap adjustment member 360 rotates at a desired angle.

By the way, the other end 154 of the bimetal 350 and the insertion slot 368 of the rotatable gap adjustment member 360 can come in various shapes, so long as the rotatable gap adjustment member 360 can be rotatably attached to and detached from the other end 154 of the bimetal 350 so that the side face 362 becomes a contact surface which is parallel or at an angle to the direction of movement of the crossbar 370.

In other words, as long as the side face 362 of the rotatable gap adjustment member 360 faces the crossbar contact surface 174*b* parallel or at an angle, the insertion parts of the bimetal 350 and reversible gap adjustment member 360 can come in various shapes.

Figure 16:
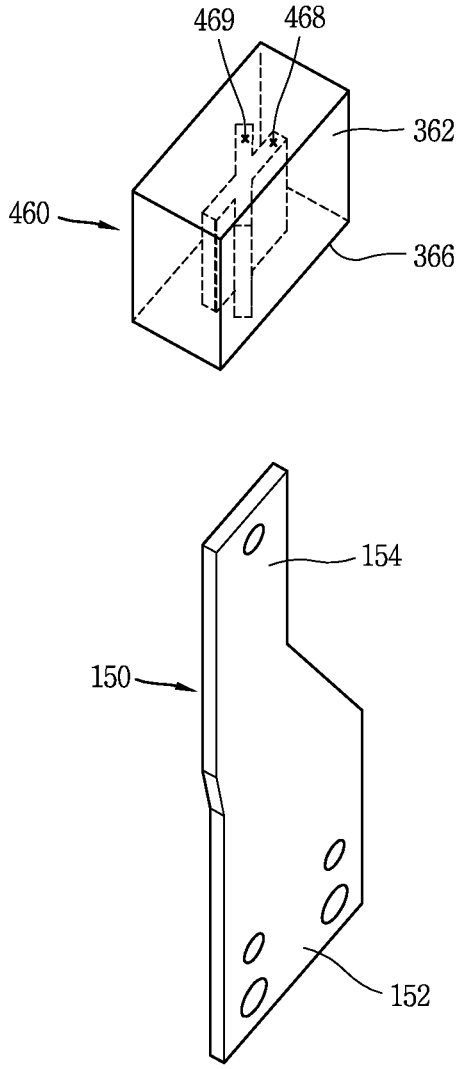
FIG. 16 is an assembly diagram showing an example of a variation of the insertion parts of the gap adjustment member and bimetal of FIG. 9.
Figure 17:
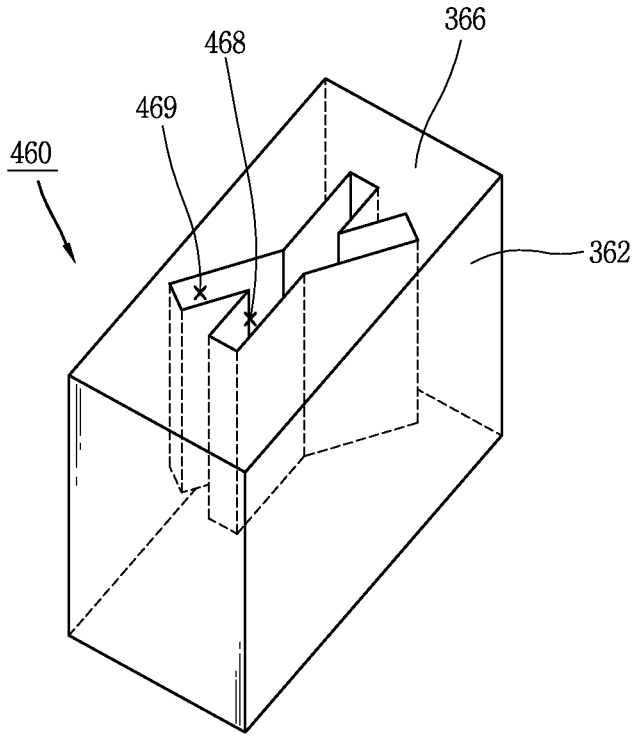
FIG. 17 is a perspective view of the gap adjustment member of FIG. 16 as viewed from the bottom.
Figure 18:
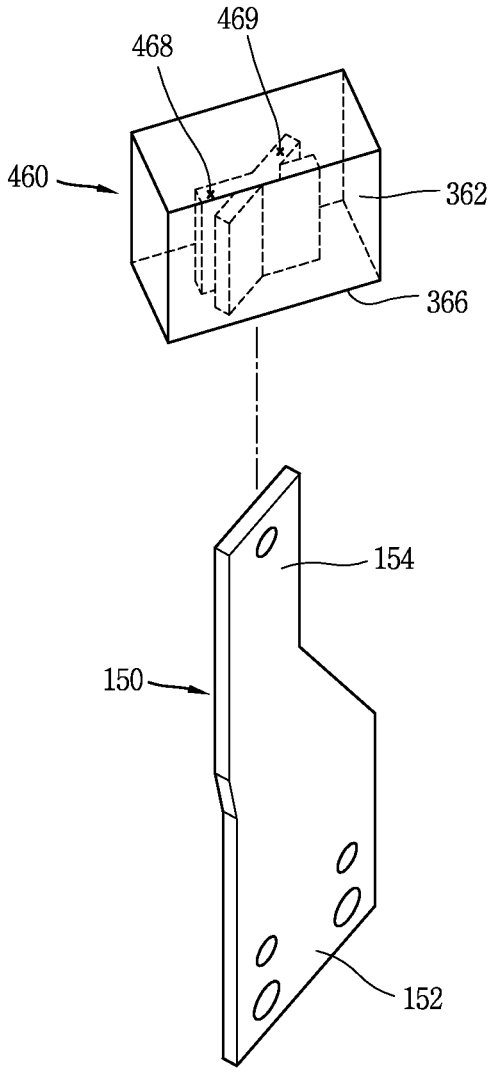
FIG. 18 is an assembly diagram showing the gap adjustment member of FIG. 16 being mounted at a tilt.

FIG. 16 is an assembly diagram showing an example of a variation of the insertion parts of the gap adjustment and bimetal of FIG. 9. FIG. 17 is a perspective view of the gap adjustment member of FIG. 16 as viewed from the bottom. FIG. 18 is an assembly diagram showing the gap adjustment member of FIG. 16 being mounted at a tilt.

In an example, as shown in FIGS. 16 to 18, insertion slots 468 and 469 may be formed in the shape of a long hole on the bottom side 366 of the rotatable gap adjustment member to receive the other end 154 of the plate-shaped bimetal 150.

The insertion slots 468 and 469 may include a first insertion slot 468, the length and depth directions of which are parallel to the side face 362 of the rotatable gap adjustment member 362.

Further, the insertion slots 468 and 469 may include a second insertion slot 469, the depth direction of which is parallel to the depth direction of the first insertion slot 468 and the length direction of which is at an angle to the length direction of the first insertion slot 468.

As used herein, the length direction of the insertion slot 468 or 469 refers to the direction along which the long side of a rectangular opening of the insertion slot 468 or 469 runs, and the depth direction of the insertion slot 468 or 469 refers to the direction of insertion of the other end 154 of the bimetal 150.

In this case, the first insertion slot 468 and the second insertion slot 469 may cross each other or not.

Figure 19:
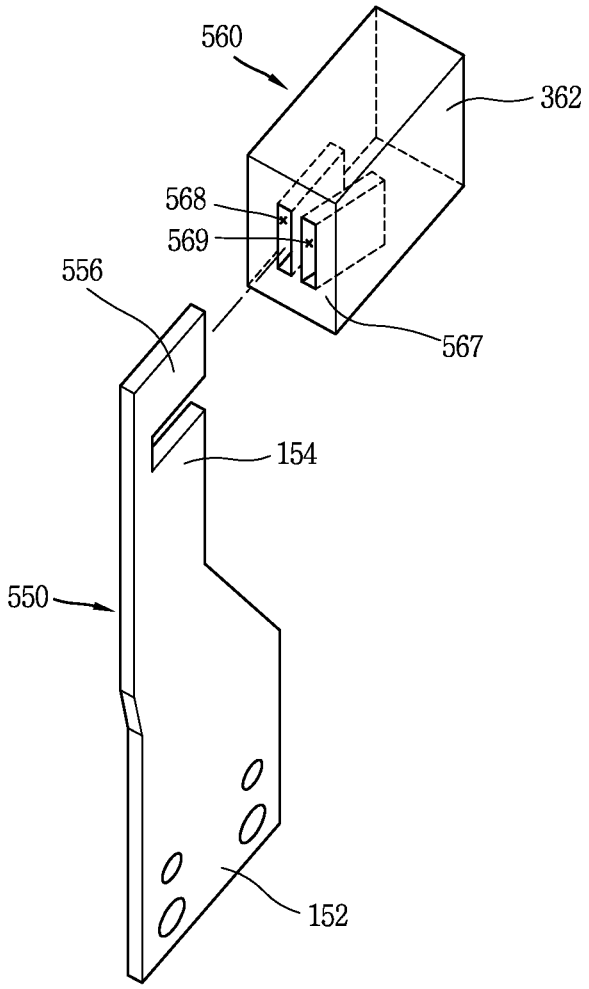
FIG. 19 is an assembly diagram showing an example different from that of FIG 16.
Figure 20:
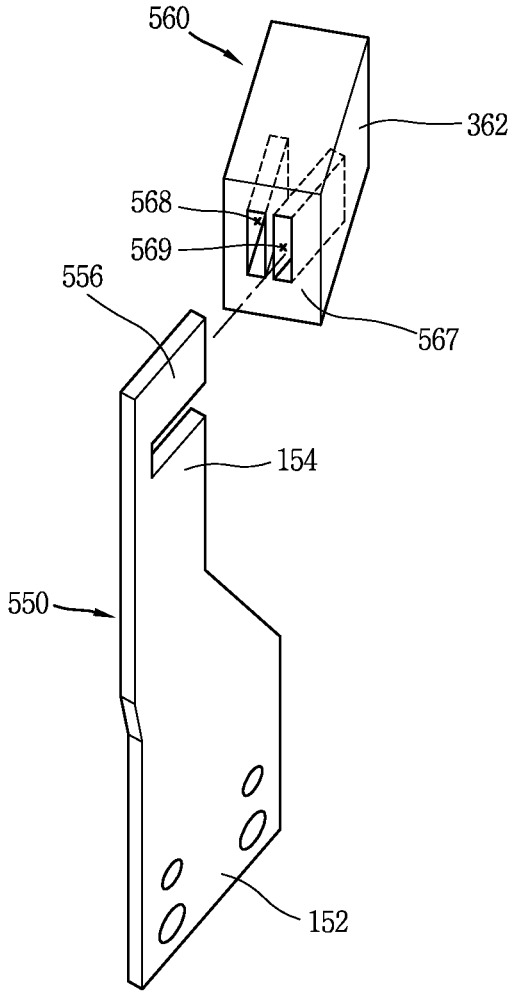
FIG. 20 is an assembly diagram showing the gap adjustment member of FIG. 19 being mounted at a tilt.

FIG. 19 is an assembly diagram showing an example different from that of FIG. 16. FIG. 20 is an assembly diagram showing the gap adjustment member of FIG. 19 being mounted at a tilt.

In another example, as shown in FIGS. 19 and 20, a first insertion slot 568 and a second insertion slot 569, the length direction of which is parallel to the side face 362 of the rotatable gap adjustment member 560, may be formed on a lateral side 567 of the rotatable gap adjustment member 560 which is perpendicular to the side face 362 of the rotatable gap adjustment member 560.

The depth direction of the first insertion slot 568 may be parallel to the side face 362 of the rotatable gap adjustment member 560.

The depth direction of the second insertion slot 569 may be at an angle to the side face 362.

In this case, a rectangular insertion protrusion 556 may extend from the other end 154 of the bimetal 550 to be inserted into the first insertion slot 568 or second insertion slot 569 formed on the lateral side 567 of the rotatable gap adjustment member 560.

As used herein, the length direction of the insertion slots 568 and 569 refers to the direction along which the long side of a rectangular opening of the insertion slots 568 and 569 runs, and the depth direction of the insertion slots 568 and 569 refers to the direction of insertion of the other end 154 of the bimetal 550.

Figure 21:
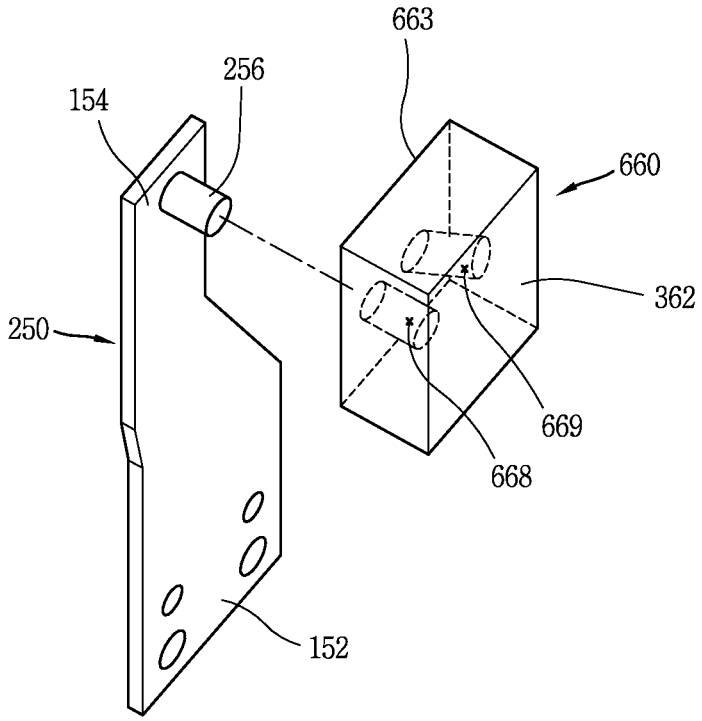
FIG. 21 is an assembly diagram showing another example different from that of FIG. 16.
Figure 22:
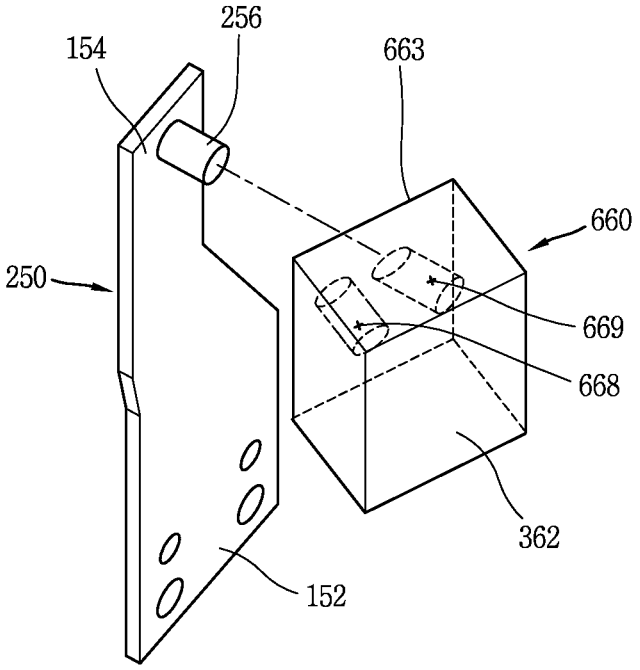
FIG. 22 is an assembly diagram showing the gap adjustment member of FIG. 21 being mounted at a tilt.

FIG. 21 is an assembly diagram showing another example different from that of FIG. 16. FIG. 22 is an assembly diagram showing the gap adjustment member of FIG. 21 being mounted at a tilt.

In yet another example, as shown in FIGS. 21 and 22, the insertion protrusion 256 protruding in the direction of curvature may be formed on the other end 154 of the bimetal 250, and a first insertion slot 668 which is perpendicular to the side face 362 of the rotatable gap adjustment member 660 and a second insertion slot 669 which is at an angle to the depth direction of the first insertion slot 668 may be formed on the rear side 663 of the rotatable gap adjustment member 660 facing the side face 362 of the rotatable gap adjustment member 660.

In addition, in the trip device NT2 for a circuit breaker according to the second exemplary embodiment of the present invention and a modification of the trip device NT2, the rotatable gap adjustment member 360, 460, 560, or 660 may be attached to and detached from the other end 154 of the bimetal 350, 150, 550, or 250. Alternatively, the rotatable gap adjustment member 360, 460, 560, or 660 may be attached to and detached from the contact portion 174 of the crossbar 170, and the illustration and detailed description thereof will be omitted because the same technical concept applies except the gap adjustment member 360, 460, 560, or 660 is attached to and detached from the crossbar 170, instead of the bimetal 350, 150, 550, or 250.

In the drawings, the same reference numerals will be given to the same parts as the conventional art and the first exemplary embodiment.

Hereinafter, the operational effects of the trip device NT2 for a circuit breaker according to the second exemplary embodiment of the present invention will be described.

As shown in FIGS. 10 and 11, in the trip device NT2 for a circuit breaker according to the second exemplary embodiment of the present invention, the rotatable gap adjustment member 360 may be mounted on the bimetal 350 so that the side face 362 becomes a contact surface which is at an angle or parallel to the direction of movement of the crossbar 170. In other words, the rotatable gap adjustment member 360 may be mounted on the bimetal 350 to make the side face 362 face the crossbar contact surface 174*b* at an angle or parallel.

When the rotatable gap adjustment member 360 is mounted on the bimetal 350 so that the side face 362 faces the crossbar contact surface 174*b* at an angle, the rotatable gap adjustment member 360 functions to adjust the rated current of the circuit breaker depending on the position of the crossbar 170 on the rotating shaft. In other words, the rotatable gap adjustment member 360 functions to implement the circuit breaker as the thermal adjustable type circuit breaker.

More specifically, the crossbar 170 may be moved in the direction of the rotating shaft by turning a knob 180, with one end brought into contact with the slot portion 176 and the other end exposed to the surface of the case 10 of the circuit breaker.

As such, the crossbar contact surface 174*b* may be shifted in position.

As a result, the gap between the contact surfaces 174*b* and 362 may be adjusted depending on which part of the side face 362 of the rotatable gap adjustment member 360, which is a contact surface of the rotatable gap adjustment member 360, the crossbar contact surface 174*b* is brought into contact with.

As the gap is adjusted, the rated current of the circuit breaker can be adjusted.

For example, if the gap is small, even a slight curvature of the bimetal 350 can bring the side face 362 of the rotatable gap adjustment member 360 into contact with the crossbar contact surface 174*b* to trigger a trip operation. That is, a circuit breaker with a low current rating is achieved.

On the other hand, if the gap is large, the bimetal 350 must be curved sharply to bring the side face 362 of the rotatable gap adjustment member 160 into contact with the crossbar contact surface 174*b* to trigger a trip operation. That is, a circuit breaker with a high current rating is achieved.

Meanwhile, once the rotatable gap adjustment member 360 is mounted on the bimetal 350 so that the side face 362 faces the crossbar contact surface 174*b* parallel, the rotatable gap adjustment member 360 functions to fix the rated current of the circuit breaker at a predetermined value regardless of the movement of the crossbar 170 in the direction of the rotating shaft or the occurrence of any scatter diagram of the position of the crossbar 170 on the rotating shaft caused by a distribution or assembly error in the components. In other words, the rotatable gap adjustment member 360 functions to implement the thermal adjustable type circuit breaker using the thermal fixable type circuit breaker.

More specifically, the crossbar 170 may be likewise moved in the direction of the rotating shaft by turning the knob 180.

As such, the crossbar contact surface 174*b* may be shifted in position.

Even with this positional shift, the gap between the contact surfaces 174*b* and 362 may be kept constant even if the crossbar contact surface 174*b* is brought into contact with any part of the side face 362, which is a contact surface of the rotatable gap adjustment member 360.

Moreover, distribution assembly errors may occur in the components of the trip device during manufacture.

This may cause a deviation in the position of the crossbar 170, i.e., the crossbar contact surface 174*b*, on the rotating shaft.

Even with this deviation, as described above, the gap between the contact surfaces 174*b* and 362 is kept constant even if the crossbar contact surface 174*b* is brought into contact with any part of the side face 362 of the rotatable gap adjustment member 360.

Accordingly, the bimetal 350 must be curved sharply to bring the rear side 164 of the rotatable gap adjustment member 360 into contact with the crossbar contact surface 174*b* to trigger a trip operation. That is, a circuit breaker with a rate current fixed at a predetermined value is achieved.

The trip device NT2 for a circuit breaker according to the second exemplary embodiment of the present invention may include the cylindrical insertion slot 368 and the insertion protrusion 356 as the insertion parts of the rotatable gap adjustment member 360 and bimetal 350.

Therefore, the rotatable gap adjustment member 360 rotates at a desired angle.

As shown in FIG. 15A, FIG. 15B and FIG. 15C, the range of adjustment of the gap between the contact surfaces 174*b* and 362 can be varied by adjusting the angle of rotation of the rotatable gap adjustment member.

The trip device NT2 for a circuit breaker according to the second exemplary embodiment of the present invention includes a crossbar 170 rotatably installed to perform the trigger function and bimetal 350 that is curved upon the occurrence of an abnormal current and presses and rotates the crossbar 170 by the rotatable gap adjustment member.

The crossbar 170 may be movable in the direction of the rotating shaft.

The rotatable gap adjustment member 360 may include a side face 362 which is flat.

The rotatable gap adjustment member 360 may be rotatably attached to and detached from either the crossbar 170 or the bimetal 350 so that the side face 362 becomes a contact surface which is parallel or at an angle to the direction of movement of the crossbar 170.

As such, when the side face 362 becomes the contact surface which is at an angle to the direction of movement of the crossbar 170, the trip device NT2 for a circuit breaker according to the second exemplary embodiment of the present invention can adjust the gap between the contact surfaces 174*b* and 362 depending on the position of the crossbar 170 on the rotating shaft. In other words, the thermal adjustable type circuit breaker for adjusting the rated current can be implemented.

When the side face 362 becomes the contact surface which is parallel to the direction of movement of the crossbar 170, the trip device NT2 for a circuit breaker according to the second exemplary embodiment of the present invention can keep the gap between the contact surfaces 174*b* and 362 constant regardless of the position of the crossbar 170 on the rotating shaft. In other words, the thermal adjustable type circuit breaker for fixing the rated current at a predetermined value can be implemented.

Accordingly, the trip device NT2 for a circuit breaker according to the second exemplary embodiment of the present invention contributes to reducing manufacturing costs by using the same components for the two different types of circuit breakers.

Besides, the trip device NT2 for a circuit breaker according to the second exemplary embodiment of the present invention can solve the problem of deterioration in the reliability of a trip operation by minimizing a scatter diagram of overcurrent caused by a distribution or assembly error in the components when implementing the thermal adjustable type circuit breaker.

As for the operational effects of the modification of the above-described trip device NT2 for a circuit breaker according to the second exemplary embodiment of the present invention, the angle of rotation of the rotatable gap adjustment member 460, 560, and 660 is more limited compared with that of the second exemplary embodiment.

The range of adjustment of the gap between the contact surfaces 362 and 174*b* cannot be varied due to limits on the angle of rotation of the rotatable gap adjustment member 460, 560, and 660.

Aside from this exception, the operational effects of the modification of the above-described trip device NT2 for a circuit breaker according to the second exemplary embodiment of the present invention are identical or substantially identical to those of the first exemplary embodiment, so a description thereof will be omitted.

Other elements and operational effects of a circuit breaker, except for a trip device, according to the present invention are identical to those of the conventional art, so detailed descriptions thereof will be omitted.

As explained above, a trip device for a circuit breaker according to the present invention includes a crossbar rotatably installed to perform the trigger function and bimetal that is curved upon the occurrence of an abnormal current and presses and rotates the crossbar by a gap adjustment member.

The crossbar may be movable in the direction of the rotating shaft.

The gap adjustment member may be attached to and detached from either the crossbar or the bimetal at varying angles so that a contact surface is parallel or at an angle to the direction of movement of the crossbar.

Consequently, the trip device for a circuit breaker according to the present invention allows for implementing the thermal adjustable type circuit breaker for adjusting the rated current and the thermal fixable type circuit breaker for fixing the rated current at a predetermined value, and solves the problem of deterioration in the reliability of a trip operation by minimizing a scatter diagram of overcurrent caused by a distribution or assembly error in the components when implementing the thermal adjustable type circuit breaker.

What is claimed is:

1. A trip device for a circuit breaker, the trip device comprising:

a crossbar that performs a trigger function and that moves in a direction of movement of a rotating shaft of the crossbar; and a bimetal that curves upon occurrence of an abnormal current and presses and rotates the crossbar via a gap adjustment member, wherein the crossbar comprises:

a pipe-like body portion; and a contact portion extending from the body portion;

wherein the contact portion comprises:

a cylindrical contact protrusion protruding in the direction of the tangent to a circular trajectory around the rotating shaft; and a crossbar contact surface formed at right angles to the length of the cylindrical contact protrusion at the end of the contact portion;

wherein the gap adjustment member comprises:

a coupling part that attaches to and detaches from the bimetal; and a gap adjustment part that is formed on an upper part of the coupling part, the gap adjustment part adjusting the gap between the bimetal and the crossbar;

wherein the gap adjustment part comprises:

a flat first side that is parallel to the crossbar contact surface; and a sloped second side that is formed on a back of the flat first side, the sloped second side being inclined in a horizontal direction to the crossbar contact surface; and wherein a rectangular shaped recess is formed on a bottom side of the coupling part to receive an end of the bimetal.

2. The trip device of claim 1, wherein length and depth directions of the recess are parallel to the first side.

* * * * *